US008636893B2

(12) United States Patent
Omelchenko et al.

(10) Patent No.: US 8,636,893 B2
(45) Date of Patent: Jan. 28, 2014

(54) PROCESS FOR PRODUCING CHLORINE WITH LOW BROMINE CONTENT

(75) Inventors: Yuri Alexeevich Omelchenko, Toronto (CA); Marek Lipsztajn, Etobicoke (CA); Tomasz Jerzy Dluzniewski, Mississauga (CA)

(73) Assignee: Superior Plus LP, Calgary, Alberta (CA)

( * ) Notice: Subject to any disclaimer, the term of this patent is extended or adjusted under 35 U.S.C. 154(b) by 0 days.

(21) Appl. No.: 13/286,242

(22) Filed: Nov. 1, 2011

(65) Prior Publication Data

US 2012/0186990 A1 Jul. 26, 2012

Related U.S. Application Data

(63) Continuation-in-part of application No. 13/067,685, filed on Jun. 21, 2011.

(60) Provisional application No. 61/436,313, filed on Jan. 26, 2011.

(51) Int. Cl.
*C25B 1/26* (2006.01)

(52) U.S. Cl.
USPC ..... 205/620

(58) Field of Classification Search
USPC ..... 205/359, 406–409, 411, 510–537, 620
See application file for complete search history.

(56) References Cited

U.S. PATENT DOCUMENTS 460,370 A 9/1891 Dow
2,662,966 A 12/1952 Lindstaedt et al.
3,371,998 A 3/1968 Schambra
3,551,309 A * 12/1970 Dunn, Jr. et al. ..... 205/527
3,660,261 A 5/1972 Wright et al.
3,864,226 A * 2/1975 Spitzer ..... 205/338
5,069,884 A 12/1991 Filippone et al.

(Continued)

FOREIGN PATENT DOCUMENTS

DE 19726531 12/1998
EP 979671 11/1999

(Continued)

OTHER PUBLICATIONS

Modern Chlor-Alkali Technology, vol. 7 (1997) pp. 157-161.

(Continued)

*Primary Examiner* — Keith Hendricks
*Assistant Examiner* — Salil Jain
(74) *Attorney, Agent, or Firm* — Michael I. Stewart; Sim & McBumey

(57) ABSTRACT

Chlorine with a low bromine content is produced by electrolyzing brine to produce gaseous chlorine, alkali metal hydroxide and hydrogen, separating the gaseous chlorine from the electrolyte (anolyte in the case of the membrane process), directing electrolyte (anolyte in the case of the membrane process) to a primary dechlorination step using hydrochloric acid to remove gaseous chlorine therefrom, optionally directing depleted electrolyte (anolyte in the case of the membrane process) from the primary dechlorination step to a secondary dechlorination step using a reducing agent for chlorine and oxychlorine species, and recycling dechlorinated depleted electrolyte (anolyte in the case of the membrane process) to salt dissolvers to prepare brine for electrolysis. At least part of the gaseous chlorine generated in the primary dechlorination step is not combined with gaseous chlorine generated in the electrolysis step.

26 Claims, 4 Drawing Sheets

(56) References Cited

U.S. PATENT DOCUMENTS

| | | | | |
|---|---|---|---|---|
| 6,428,677 | B1 | 8/2002 | Bonnick et al. | |
| 7,972,493 | B2 * | 7/2011 | Davis et al. | 205/536 |
| 2006/0027463 | A1 * | 2/2006 | Lavelle et al. | 205/556 |
| 2008/0224094 | A1 | 9/2008 | Ariki et al. | |

FOREIGN PATENT DOCUMENTS

| | | |
|---|---|---|
| GB | 382512 | 10/1932 |
| GB | 526542 | 9/1940 |
| GB | 893692 | 4/1962 |
| GB | 991610 | 5/1965 |
| WO | WO2004/018355 | 3/2004 |
| WO | WO2005/068686 | 7/2005 |

OTHER PUBLICATIONS

Handbook of Chlor-Alkali Technology: Fundamentals, vol. 1 (2005) Chapter 6, pp. 446-449.

Modern Chlor-alkali Technology, vol. 4 (1990), pp. 251-259.

Ullmann's Encyclopedia of Industrial Chemistry, 5th Ed., vol. A6, VCH, 1990, pp. 409-410.

Characterization of Mercury Emissions at a Chlor-Alkali Plant, Jan. 2002, pp. 14 and 23.

Ullmann's Encyclopedia of Industrial Chemistry, 5th Ed., vol. A6, pp. 462-463.

* cited by examiner

Fig.1 A conventional membrane, chlor-alkali process ( from the Handbrook of Chlor-Alkali Technology, p.448, published in 2005 )

Fig.2 Membrane, chlor-alkali process of the present invention

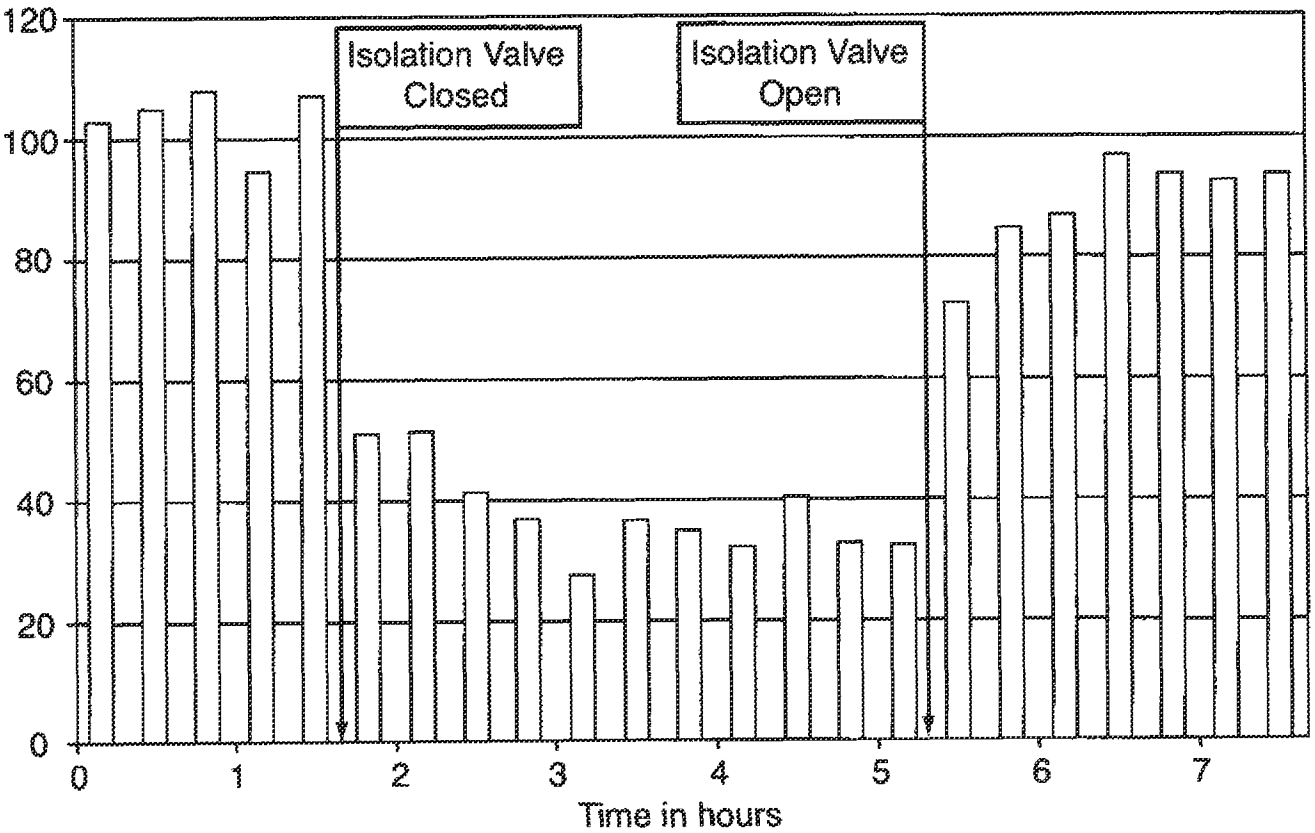
Fig.4 Time dependence of the bromine content in chlorine in one embodiment of the present invention

PROCESS FOR PRODUCING CHLORINE WITH LOW BROMINE CONTENT

REFERENCE TO RELATED APPLICATIONS

This application is a continuation-in-part of U.S. patent application Ser. No. 13/067,685 filed Jun. 21, 2011, which claims priority under 35 USC 119(e) from US Provisional Application No. 61/436,313 filed Jan. 26, 2011.

FIELD OF INVENTION

The present invention relates to methods of producing a chlorine gas, an aqueous alkali metal hypochlorite solution and liquid chlorine. More specifically, the present invention relates to a method of producing a chlorine gas and liquid chlorine having a lower bromine content than that obtained in the conventional chlor-alkali processes (particularly membrane and mercury based processes).

BACKGROUND TO THE INVENTION

Conventionally, an electrolysis of an alkali metal chloride solution, typically sodium chloride and potassium chloride solution, denoted also as brine, has been performed for the purpose of producing chlorine, sodium or potassium hydroxide, and hydrogen. Since the raw material in such processes usually contains alkali metal bromides as impurities, chlorine generated therefrom is contaminated with bromine. The bromine impurity in chlorine is less and less tolerated, especially in water treatment applications. This is because, in certain water treatment processes, bromine is at least partially converted to alkali metal bromate which is a known health hazard. Another application which requires chlorine with low bromine content is the production of various chlorinated organic compounds.

There are various approaches to dealing with the bromine contamination of the chlorine product. The first approach is to remove alkali metal bromide from the alkali metal chloride brine. Such an approach is described in numerous prior art documents, for example, U.S. Pat. Nos. 460,370, 2,622,966, 3,371,998, 5,069,884, and 6,428,677, British Patents Nos. 382,512, 526,542, 893,692, and 991,610 and Modern Chlor-Alkali Technology, Volume 7, pp. 157-159, published in 1997.

Another approach is based on the purification of chlorine product, typically by distillation (see, for example, WO 2004/018355) or another process (see European Patent No. 979,671 or US Patent Application No. 2008/0224094).

Yet another approach, described in the U.S. Pat. No. 3,660,261 and WO 2005/068686, involves an oxidation of various bromine species present in brine to alkali metal bromate, which is claimed to result in the production of chlorine with low bromine content.

All the above-described processes are very costly and, in some cases, for example distillation, also energy intensive. There is, therefore, a need to develop a relatively simple and inexpensive process which results in the production of chlorine with low bromine content.

SUMMARY OF THE INVENTION

The present invention is directed towards the provision of a method of producing chlorine with low bromine content. The present invention relates to a method for producing a chlorine gas, which method includes the steps of:

(a) electrolyzing brine to produce gaseous chlorine, alkali metal hydroxide and hydrogen, (b) separating gaseous chlorine from the electrolyte (anolyte in the case of the membrane process), (c) directing depleted electrolyte (anolyte in the case of the membrane process) to the primary dechlorination step in which hydrochloric acid is added to the depleted brine, (d) optionally directing depleted electrolyte (anolyte in the case of the membrane process) from the primary dechlorination step to the secondary dechlorination step, in which a reducing agent is added to the depleted brine, (e) optionally subjecting depleted electrolyte (anolyte in the case of the membrane process) to further purification steps, for example sulfate removal, and (f) recycling dechlorinated depleted electrolyte (anolyte in the case of the membrane process) to salt dissolvers to prepare brine for electrolysis, wherein at least part of gaseous chlorine generated in step (c) is not combined with gaseous chlorine generated in steps (a) and (b).

BRIEF DESCRIPTION OF DRAWINGS

FIG. 4 illustrates the time dependence of the bromine content in gaseous chlorine product in one embodiment of the present invention.

GENERAL DESCRIPTION OF THE INVENTION

Figure 1:
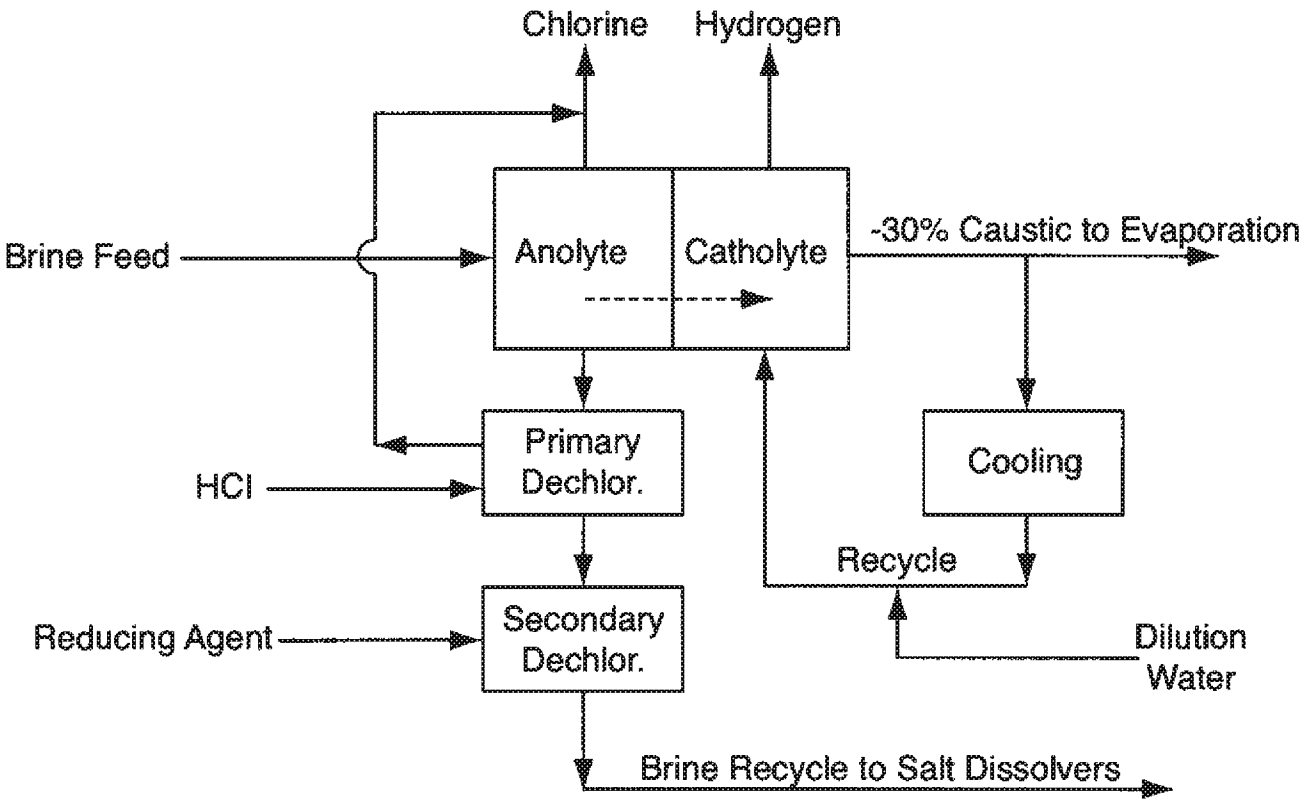
FIG. 1 is a schematic flow sheet of a conventional chlor-alkali process.

The process of the invention comprising the steps described above differs from the all known, conventional prior art processes in that chlorine produced in the electrolyzers is handled separately from the chlorine generated in the treatment of the depleted brine, for example, in the primary dechlorination step (typically performed under vacuum). The flow diagram of a conventional membrane process is shown, for example, in the Handbook of Chlor-Alkali Technology, chapter 6, p. 448 (FIG. 6.5), published in 2005 (now reproduced as FIG. 1). For a conventional mercury based process, see FIG. 6.4 on page 447 in the same Handbook.

It is believed that, by not combining both sources of chlorine (wherein chlorine removed in steps (a) and (b) is the main source of chlorine in the overall process), the main fraction (or at least a large fraction) of bromine will be contained in the chlorine removed from the depleted brine in step (c). Thus one can obtain a majority of chlorine with a low bromine content and a small fraction of chlorine containing a relatively high concentration of bromine. The latter, contaminated chlorine can be directed to any suitable purification step, for example, distillation, or may be utilized in the production of compounds which do not require high-purity chlorine as a substrate, for example, in the generation of hydrochloric acid or an impure alkali metal hypochlorite.

The chlorine contaminated with bromine, originating from the dechlorination step, preferably is subjected to a purification step in which the gas stream is washed with water or an aqueous waste stream generated in the chlor-alkali plant. Such purification step results in a preferential absorption of bromine in the water/waste stream, thus producing a purer chlorine gas. Examples of the various aqueous waste streams which can be used includes, but are not limited to, the reject brine stream from the sulfate removal process, a purge stream from the iodide removal step, a purge stream from the silica removal step, any other purge stream intended to control the level of impurities in the brine loop, the condensate from the evaporators, the condensate from hydrogen coolers and the regeneration waste stream from the ion-exchange. It is possible to adjust the pH of the water/washing solution in order to improve the absorption of bromine. The washing may be performed in one or more stages. If desired, the waste stream may be recycled until a satisfactory concentration of bromine therein is reached, before directing the waste stream to disposal.

Figure 2:
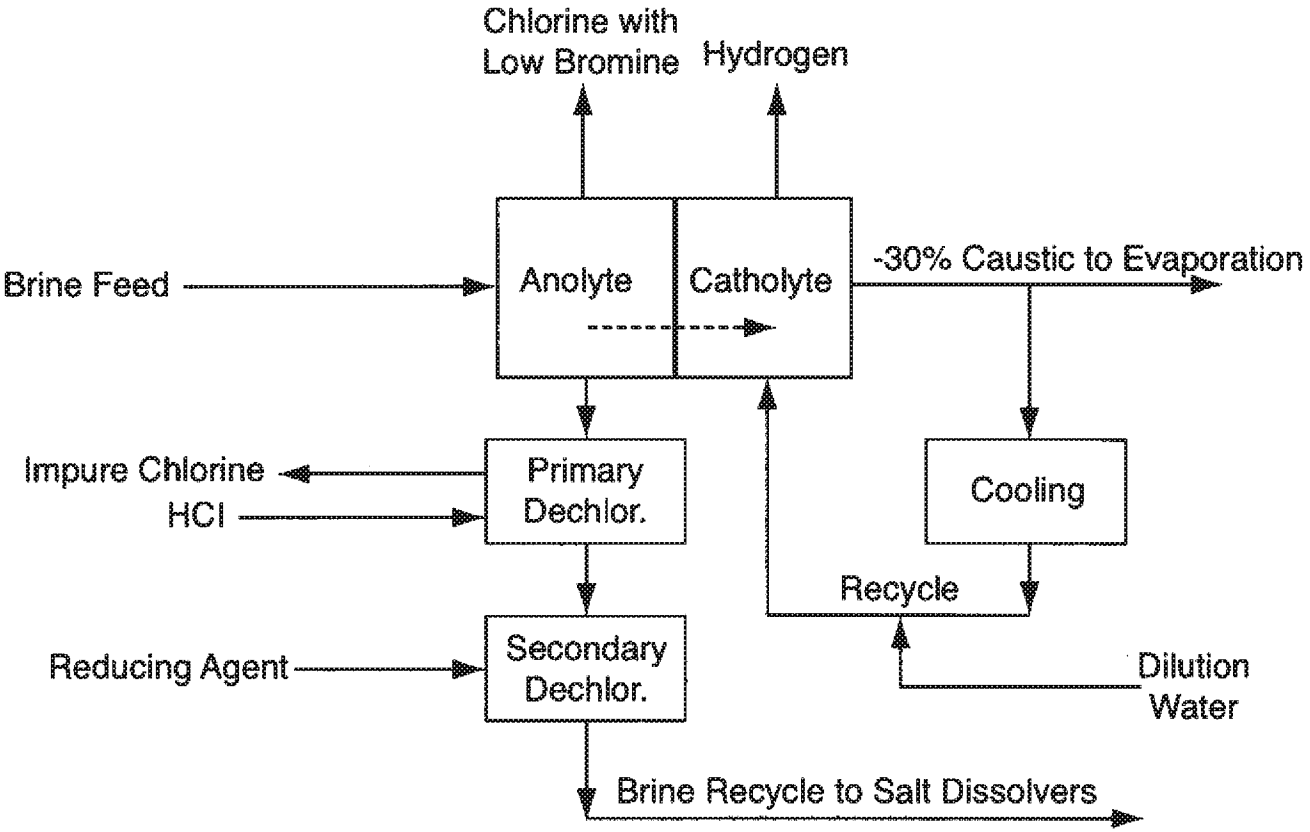
FIG. 2 is a schematic flow sheet of one embodiment of the present invention.

It is also possible to direct contaminated chlorine to disposal. If the latter option is chosen, it is possible to perform the destruction of all residual chlorine and oxychlorine species (such as, for example, chlorate and hypochlorite ions/hypochlorous acid) in the second dechlorination step (i.e. upon addition of the reducing agent and, optionally, hydrochloric acid) and possibly avoid the first dechlorination step altogether. A flow diagram of an embodiment of the process of the present invention is schematically presented in FIG. 2.

Without being bound by any particular theory, it is believed that the main sources of elemental bromine are chemical reactions taking place in the depleted brine treatment loop rather than the electrochemical cells. It is further believed that the content of bromine in the main chlorine product can be further minimized by adjusting the pH of the electrolyte (anolyte in the case of the membrane process). While the general operating pH range in the electrolyzers is typically about 3.1 to about 5.5, it is preferred to adjust the pH upward to the range about 3.5 to about 5.5, most preferably about 3.9 to about 5.5. Such pH adjustment can be conveniently achieved by, for example, the addition of hydroxide and/or carbonate to the feed brine stream. The pH of the feed brine streams utilized in the present invention is typically in the range of 8 to 11.

It is beneficial to maintain the temperature of the electrolyte (anolyte in the case of the membrane process) in the range of about 80° to about 90° C.

The novel method of the present invention can be utilized in most conventional chlor-alkali processes (in particular membrane and mercury based processes). A relatively small and inexpensive modification to the existing chlor-alkali plants results in achieving a goal of producing chlorine with low bromine content. If desired, it is possible to combine the process of the present invention with other processes involving removal of alkali metal bromide from brine such as those described, for example, in Modern Chlor-Alkali Technology, Volume 7, pp. 157-159, published in 1997, cited earlier in this patent application.

EXAMPLE

Figure 3:
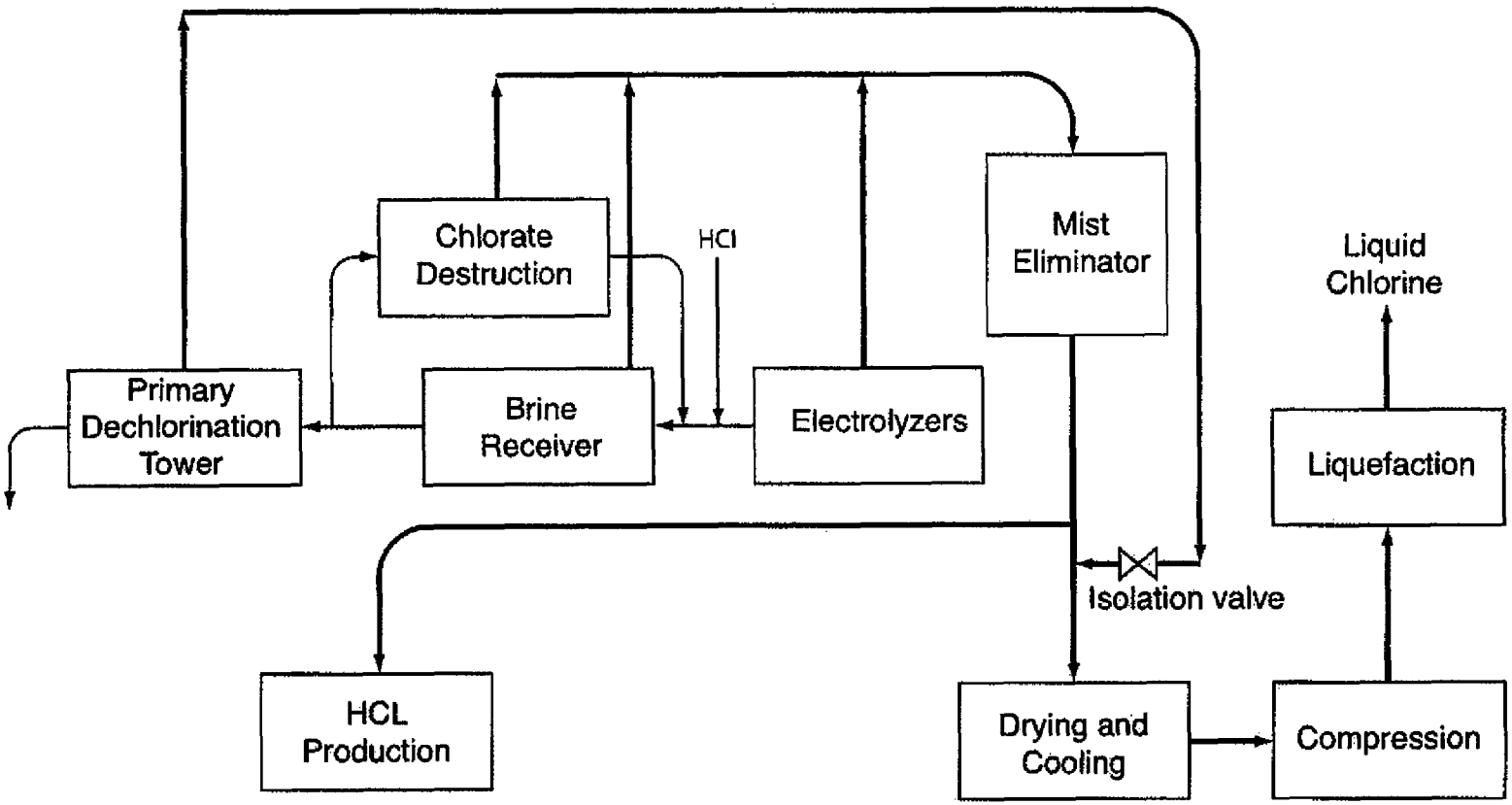
FIG. 3 is a simplified flow diagram of the chlorine handling system of one embodiment of the present invention. In the Figure, chlorine streams are represented by thick lines while brine solution streams are denoted by thin lines.

The testing of the concept of the present invention was carried out in the membrane-based, chlor-alkali plant located in Port Edwards, Wis. This plant operates two product lines, one producing chlorine, sodium hydroxide and hydrogen and the second one producing chlorine, potassium hydroxide and hydrogen. A simplified flow diagram of the chlorine handling system in this plant is presented in FIG. 3. Both sodium and potassium hydroxide product lines share certain steps associated with the handling of chlorine, namely: drying and cooling, compression and liquefaction. Other steps which involve handling of two different electrolytes (sodium chloride and potassium chloride), such as, for example, the operation of the primary dechlorination towers, are separate for both product lines. It is noted that, for the purpose of simplicity, some steps, such as, for example, secondary dechlorination step, have been omitted in FIG. 3. Under normal operating conditions (i.e., in the conventional operation) the product chlorine originating from the primary dechlorination towers of both product lines is combined with the chlorine removed from the electrolyzers (isolation valve shown in FIG. 3 is open).

During testing of the concept of the present invention, the content of bromine was frequently monitored in the final chlorine product after the compression step. The time dependence of the bromine content in gaseous chlorine product during testing is graphically presented in FIG. 4. During the conventional operation (isolation valve open) the content of bromine in gaseous chlorine product was close to 100 ppm (parts per million). Upon closing of this valve, i.e., by separating the chlorine originating from the primary dechlorination tower from that originating from the electrolyzers, the bromine content dropped to an average of 38 ppm. At the same time, the bromine content determined in the impure chlorine separated from the primary dechlorination towers was found to be 5020 ppm and 2880 ppm for the sodium and potassium lines, respectively. The pH values of the anolytes, measured in the sodium and potassium lines electrolyzers were 4.5 and 3.6, respectively. When the isolation valve was closed, the chlorine product containing relatively large bromine contamination was directed to disposal. It is understood, however, that with minor modification to the overall system, this impure chlorine product can be purified or utilized as is, for example, in the hydrochloric acid production or alkali metal hypochlorite generation.

The experiments presented above clearly show that, by separating the chlorine product originating in the primary dechlorination tower from that originating in the electrolyzers, a very significant improvement in the chlorine product purity can be achieved (over 60%). These experiments also show that the anolyte pH has a significant effect on the contribution of bromine impurity (the higher the pH, the higher the content of bromine in chlorine originating in the primary dechlorination tower, thus the lower the contamination of the final chlorine product upon separation of both sources of chlorine). The positive effect of a higher anolyte pH on the purity of chlorine was further confirmed by adjusting the pH in the potassium line electrolyzers upward from 3.6 to 3.8 and measuring the bromine content in the chlorine product originating in the electrolyzers, a decrease of bromine content of nearly 30% was observed.

A further improvement in the separation of the impure chlorine from the pure chlorine can be achieved by additional changes to the chlorine handling system of the embodiment shown in FIG. 3, For example, it is possible to separate the main source of chlorine (originating from the electrolyzers) from that originating not only in the primary dechlorination tower (as shown above in FIG. 3) but also in certain other steps involving depleted brine handling system, such as, for example, brine receiver or chlorate destruction, the latter step involving a hydrochloric acid and heat addition. It is expected that the purest product can be achieved when chlorine originating in the electrolyzers is handled separately from all other sources of chlorine. It is noted that the primary dechlorination step shown in FIGS. 1 and 2 encompasses not only the primary dechlorination tower but also the brine receiver and chlorate destruction step.

SUMMARY OF THE DISCLOSURE

In summary of this disclosure, the present invention provides a procedure for producing gaseous chlorine having a low bromine content. Modifications are possible within the scope of the invention.

What we claim is:

1. A method of producing chlorine with a reduced bromine content from brine containing some amount of bromine compounds, which comprises:

(a) electrolyzing the brine to produce gaseous chlorine, alkali metal hydroxide, hydrogen and a depleted brine, (b) directing the depleted brine to a primary dechlorination step using hydrochloric acid to remove gaseous chlorine therefrom, (c) optionally directing the depleted brine from the primary dechlorination step to a secondary dechlorination step using a reducing agent for chlorine and oxychlorine species, and (d) recycling the dechlorinated depleted brine to salt dissolvers to prepare brine for electrolysis;

wherein at least part of the gaseous chlorine generated in step (b) is not combined with the gaseous chlorine generated in step (a).

2. The process of claim 1 wherein none of the gaseous chlorine generated in step (b) is combined with the gaseous chlorine generated in step (a).

3. The process of claim 1 wherein the chlorine generated in step (b) is utilized to generate hydrochloric acid.

4. The process of claim 3 wherein the chlorine generated in step (b), prior to utilization to generate hydrochloric acid, is washed with water or an aqueous waste stream originating in a chlor-alkali plant in which the electrolyzing step is effected.

5. The process of claim 4 wherein said aqueous waste stream is a reject brine stream from a sulfate-removal process in said chlor-alkali plant.

6. The process of claim 1 wherein the chlorine generated in step (b) is utilized to generate alkali metal hypochlorite.

7. The process of claim 6 wherein the chlorine generated in step (b), prior to utilization to generate alkali metal hypochlorite, is washed with water or an aqueous waste stream originating in a chlor-alkali plant in which the electrolyzing step is effected.

8. The process of claim 7 wherein said aqueous waste stream is a reject brine stream from a sulfate removal process in the chlor-alkali plant.

9. The process of claim 1 wherein the electrolysis step (a) is carried out at a pH of about 3.1 to about 5.5.

10. The process of claim 1 wherein the electrolyzing step (a) is carried out at a pH of about of about 3.5 to about 5.5.

11. The process of claim 1 wherein the electrolyzing step (a) is carried out at a pH of about 3.9 to about 5.5.

12. The process of claim 1 wherein the electrolyzing step (a) is effected at a temperature of about 80° to about 90° C.

13. The process of claim 1 wherein the depleted brine is subjected to a further purification step.

14. The process of claim 13 wherein the gaseous chlorine formed in processing of depleted brine is not mixed with the gaseous chlorine formed in step (a).

15. The process of claim 2 wherein the chlorine generated in step (b) is utilized to generate hydrochloric acid.

16. The process of claim 15 wherein the chlorine generated in step (b), prior to utilization to generate hydrochloric acid, is washed with water or an aqueous waste stream originating in a chlor-alkali plant in which the electrolyzing step is effected.

17. The process of claim 16 wherein said aqueous waste stream is a reject brine stream from a sulfate-removal process in said chlor-alkali plant.

18. The process of claim 2 wherein the chlorine generated in step (b) is utilized to generate alkali metal hypochlorite.

19. The process of claim 18 wherein the chlorine generated in step (b), prior to utilization to generate alkali metal hypochlorite, is washed with water or an aqueous waste stream originating in a chlor-alkali plant in which the electrolyzing step is effected.

20. The process of claim 19 wherein said aqueous waste stream is a reject brine stream from a sulfate-removal process in the chlor-alkali plant.

21. The process of claim 2 wherein the electrolyzing step (a) is carried out at a pH of about 3.1 to about 5.5.

22. The process of claim 2 wherein the electrolyzing step (a) is carried out at a pH of about 3.9 to about 5.5.

23. The process of claim 2 wherein the electrolyzing step (a) is effected at a temperature of about 80° to about 90° C.

24. The process of claim 2 wherein the depleted brine is subjected to a further purification step.

25. The process of claim 24 wherein the gaseous chlorine formed in processing of depleted brine is not mixed with the gaseous chlorine formed in step (a).

26. The process of claim 25 wherein said gaseous chlorine formed in processing of depleted brine is washed with water or an aqueous waste stream originating in a chlor-alkali plant in which the electrolyzing step is effected.

* * * * *